US005542892A

United States Patent [19]

Buhler

[11] Patent Number: 5,542,892

[45] Date of Patent: Aug. 6, 1996

[54] SUPPORTING CHASSIS FOR A TREADMILL

[75] Inventor: Kirk A. Buhler, Corona, Calif.

[73] Assignee: Unisen, Inc., Tustin, Calif.

[21] Appl. No.: 290,149

[22] Filed: Aug. 15, 1994

[51] Int. Cl.[6] ..... A63B 22/02

[52] U.S. Cl. ..... 482/54; 482/51

[58] Field of Search ..... 482/54, 51

[56] References Cited

U.S. PATENT DOCUMENTS

| | | |
|---|---|---|
| 756,604 | 4/1904 | Dodge . |
| 759,296 | 5/1904 | Morairty . |
| 780,145 | 1/1905 | Vaughan . |
| 1,016,729 | 2/1912 | Barrett . |
| 1,064,968 | 6/1913 | Hagen . |
| 1,082,940 | 12/1913 | Flora . |
| 1,211,765 | 1/1917 | Schmidt . |
| 1,364,699 | 1/1921 | Brown . |
| 1,766,089 | 6/1930 | Wood . |
| 1,824,406 | 9/1931 | Petersime . |
| 1,919,627 | 7/1933 | Fitzgerald . |
| 2,017,885 | 10/1935 | Atcheson . |
| 2,239,076 | 12/1941 | Biedess . |
| 2,329,687 | 9/1943 | Becker . |
| 2,399,915 | 5/1946 | Drake . |
| 2,578,871 | 12/1951 | Woldring . |
| 2,812,180 | 11/1957 | Cymbal . |
| 2,863,555 | 12/1958 | Jaritz . |
| 2,996,295 | 8/1961 | Smith . |
| 3,319,767 | 5/1967 | Breternitz . |
| 3,408,067 | 10/1968 | Armstrong . |
| 3,590,980 | 7/1971 | Bengtason . |
| 3,628,654 | 12/1971 | Haracz . |
| 3,642,276 | 2/1972 | Cutter . |
| 3,659,845 | 5/1972 | Quinton . |
| 3,689,066 | 9/1972 | Hagen . |
| 3,711,090 | 1/1973 | Fiedler . |
| 3,731,917 | 5/1973 | Townsend . |
| 3,814,420 | 6/1974 | Encke . |
| 3,870,297 | 3/1975 | Elder . |
| 3,952,861 | 4/1976 | Holmqvist . |
| 3,976,192 | 8/1976 | Müller . |
| 4,063,726 | 12/1977 | Wilson . |
| 4,077,626 | 3/1978 | Newman . |
| 4,087,088 | 5/1978 | Kelso . |
| 4,146,222 | 3/1979 | Hribar . |
| 4,167,938 | 9/1979 | Remih . |
| 4,204,673 | 5/1980 | Speer, Sr. . |
| 4,350,336 | 9/1982 | Hanford . |
| 4,374,587 | 2/1983 | Ogden . |
| 4,423,864 | 1/1984 | Wilk . |

(List continued on next page.)

FOREIGN PATENT DOCUMENTS

| | | |
|---|---|---|
| 0196877 | 10/1986 | European Pat. Off. . |
| 0403924 | 12/1988 | European Pat. Off. . |
| 2616132 | 6/1937 | France . |
| 1271191 | 1/1962 | France . |
| 1550970 | 3/1964 | France . |

*Primary Examiner*—Lynne A. Reichard
*Attorney, Agent, or Firm*—Daniel L. Dawes

[57] ABSTRACT

An improved exercise treadmill device having a continuous belt upon which an exercise user walks or runs, which belt is supported by cushioned deck. The deck is disposed within the chassis of the treadmill underneath the belt and in turn is supported by a recessed shelf provided by the chassis on a peripheral shock absorber or resilient foam pad. An antifriction panel is disposed between the underside of the belt and the upper side of the deck between the belt and the deck. The resilient panel is removable so that when worn or ineffective it can be easily and quickly replaced without requiring replacement of the deck. An upper belt recess provided by the chassis fully encloses the end of the deck and belt. A shock absorber is provided on the chassis above the belt and deck so that any rebound contact caused by heavy foot falls on the belt are cushioned by the upper shock absorber.

The treadmill also provides a pair of marks on the belt and a pair of markers on the chassis of the treadmill so that when the belt is stretched and the pair of marks aligned with the pair of markers, the correct or optimal amount of tension is applied to the belt.

14 Claims, 2 Drawing Sheets

U.S. PATENT DOCUMENTS

| | | |
|---|---|---|
| 4,509,510 | 4/1985 | Hook . |
| 4,544,152 | 10/1985 | Taitel . |
| 4,548,405 | 10/1985 | Lee et al. . |
| 4,591,147 | 5/1986 | Smith . |
| 4,602,779 | 7/1986 | Ogden . |
| 4,614,337 | 9/1986 | Schönenberger . |
| 4,616,822 | 10/1986 | Trulaske et al. . |
| 4,729,558 | 3/1988 | Kuo . |
| 4,736,944 | 4/1988 | Johnson et al. . |
| 4,791,147 | 12/1988 | Smith . |
| 4,819,583 | 4/1989 | Guerra . |
| 4,865,313 | 9/1989 | Kuo . |
| 4,872,664 | 10/1989 | Parker . |
| 4,886,266 | 12/1989 | Trulaske . |
| 4,938,469 | 7/1990 | Crandell . |
| 4,938,743 | 7/1990 | Lee et al. . |
| 4,944,506 | 7/1990 | Keller et al. . |
| 4,974,831 | 12/1990 | Dunham . |
| 4,984,810 | 1/1991 | Stearns et al. . |
| 5,018,722 | 5/1991 | Whitmore . |
| 5,072,928 | 12/1991 | Stearns et al. . |
| 5,088,729 | 2/1992 | Dalebout . |
| 5,100,127 | 3/1992 | Melnick . |
| 5,123,641 | 6/1992 | Abboudi et al. . |
| 5,163,885 | 11/1992 | Wanzer et al. . |
| 5,184,988 | 2/1993 | Dunham . |
| 5,203,800 | 4/1993 | Meredith . |
| 5,226,866 | 7/1993 | Engel et al. . |
| 5,250,012 | 10/1993 | Meredith . |
| 5,279,528 | 1/1994 | Dalebout et al. . |
| 5,295,929 | 3/1994 | Weisz . |

FOREIGN PATENT DOCUMENTS

| | | |
|---|---|---|
| 0592657 | 7/1933 | Germany . |
| 1166086 | 2/1934 | Germany . |
| 3806750 | 9/1989 | Germany . |
| 4003871 | 8/1991 | Germany . |
| 0135206 | 12/1985 | Sweden . |
| 0191377 | 11/1968 | Switzerland . |
| 0384019 | 12/1947 | United Kingdom . |
| 2184361 | 12/1990 | United Kingdom . |

SUPPORTING CHASSIS FOR A TREADMILL

BACKGROUND OF THE INVENTION

1. Field of the Invention

The invention relates to the field of treadmills, and in particular to the bodies or chassis by which the treadmill belt is supported.

2. Description of the Prior Art

A treadmill is an exercise device which permits walking or running by moving a continuous belt along the length of a chassis. The belt which is controlled by a motor and appropriate control electronics slides over a supporting deck. The belt is flexible and is unable to rigidly support the weight of the user. As the exerciser or user walks or runs on the belt, the belt is pressed against the underlying supporting deck to provide mechanical support for the exerciser since the belt while substantially nonextensible, is typically made of a reinforced flexible synthetic rubber.

Such supporting decks, in turn, are rigidly affixed to or supported by the treadmill chassis, thereby effectively providing a hard moving surface for the exerciser to walk or run on. To minimize friction and wear, the surface of the supporting deck in contact with the moving belt is provided with a waxed and/or polished surface. In time, this surface becomes worn or depleted and the amount of friction between the moving belt and deck increases. Therefore, the supporting deck must either be resurfaced or replaced periodically depending on wear. In the case of treadmills used in commercial exercising salons, the typical life time of the supporting deck is approximately six months.

In addition, because it provides rigid support, the shock of the user's step is reflected by the supporting deck back to the user's foot, ankle and leg in the same manner as reactive forces are imposed on a walker, jogger or runner exercising on hard paved streets or sidewalks. Over a long period of time, this shock can have deleterious effects to the joints of some exercisers.

What is needed is some type of support for a moving treadmill surface that provides rigid support for the belt and exerciser. Further, what is needed is a supporting surface for a treadmill belt which is not characterized by the hard shocks which are normally encountered when walking upon a rigidly supported treadmill belt.

The treadmill belt is intended to be tensioned by a predetermined amount of stretch depending upon the inherent material characteristics of the belt. The belt is typical supplied by the manufacturer with a predetermined percentage of stretch required. If tensioned too highly, it may bind on the treadmill. If tensioned too loosely, it may slip and wear excessively. Tensioning is conventionally accomplished by adjusting the distance between the belt rollers (not shown) at each end of the treadmill. Prior art methods for tensioning include the use of specialized tension meters to measure the tensile force across the width of the belt. Such meters are difficult to use properly, expensive, and generally not available to personnel who maintain the treadmills or change the belts. Otherwise, tension is adjusted by trial and error to a tension which seems to work is achieved.

Therefore, what is needed is some type of means and method which can accurately adjust belt tension, even when a new belt with new characteristics is installed.

BRIEF SUMMARY OF THE INVENTION

The invention is an improvement in a treadmill exercise device comprising a chassis and a continuous belt supported within the chassis. The belt in turn is supported by an underlying deck. The improvement comprises a shock absorber disposed in the chassis beneath the deck. The shock absorber supports the deck and thus the belt so that impulsive foot falls on the belt are cushioned.

The shock absorber comprises a layer of resilient foam disposed on the chassis underneath the deck. The deck has longitudinal edges and the resilient foam is disposed underneath the deck beneath a substantial portion of the longitudinal edges of the deck. Alternatively, the deck has a periphery and the resilient foam is disposed on the chassis beneath the periphery of the deck.

The improvement further comprises an upper shock absorber disposed on the chassis above the belt for cushioning rebound impact of the belt and deck as a result of impulsive foot falls on the belt and deck. The upper shock absorber is comprised of resilient foam.

The improvement further comprises an antifriction panel removably disposed on the deck between the deck and the belt.

The invention is also characterized as an improvement in a treadmill having a chassis and endless belt disposed within the chassis and a deck for supporting the belt when a user exercises thereon. The deck is disposed beneath the belt and is supported in turn by the chassis. The improvement comprises an antifriction panel temporarily disposed on the deck between the deck and the belt. The antifriction panel is secured to the deck while the belt moves across the antifriction panel when the treadmill is in use and is thereafter removable and replaced by a replacement antifriction panel when the antifriction panel becomes ineffective.

Still further, the invention is defined as an improved chassis for a treadmill exercise apparatus having a continuous belt comprising chassis sides extending longitudinal along each side of the belt. A lower shock absorber is disposed within the upper side member recess for supporting the deck. The lower shock absorber absorbs compulsive foot fall shocks transmitted to the deck by the user through the belt. As a result, the chassis provides cushioned support for the user during exercise. The chassis side is extended at its lower portion to form a foot to provide a clearance underneath the lower belt return.

The invention is also an improvement in a treadmill having a chassis, an endless belt disposed within said chassis, and a deck. The improvement comprises an expendable and replaceable lubricating block disposed within the deck for lubricating the belt and deck. A portion of the lubricating block is dispensed between the belt and deck over time according to abrasion of the block by the belt.

The invention is further an improvement in a treadmill having a chassis, an endless belt disposed within the chassis, the belt being adjustable on the chassis to tension the belt. The improvement comprises a pair of marks defined on the belt at a first predetermined distance apart from each other. A pair of markers is defined on or relative to the chassis at a second predetermined distance apart from each other. The first predetermined distance is less than the second predetermined distance by a predetermined amount as determined by characteristics of the belt. The belt, when stretched on the chassis such that the pair of marks on the belt become aligned with the markers on the chassis, has a predetermined amount of tension defined therein.

The invention may be better visualized by now turning to the following drawings wherein like elements are referenced by like numerals.

The invention and its various embodiments may now be better understood by turning to the following detailed description.

DETAILED DESCRIPTION OF THE PREFERRED EMBODIMENT

An improved exercise treadmill device having a continuous belt upon which an exercise user walks or runs, which belt is supported by a cushioned deck. The deck is disposed within the chassis of the treadmill underneath the belt and in turn is supported by a recessed shelf provided by the chassis on a peripheral shock absorber or resilient foam pad. An antifriction panel is disposed between the underside of the belt and the upper side of the deck between the belt and the deck. The resilient panel is removable so that when worn or ineffective it can be easily and quickly replaced without requiring replacement of the deck. An upper recess provided by the chassis fully encloses the end of the deck. A shock absorber is provided on the chassis above the belt and deck so that any rebound contact caused by heavy foot falls on the belt are cushioned by the upper shock absorber.

Figure 1:
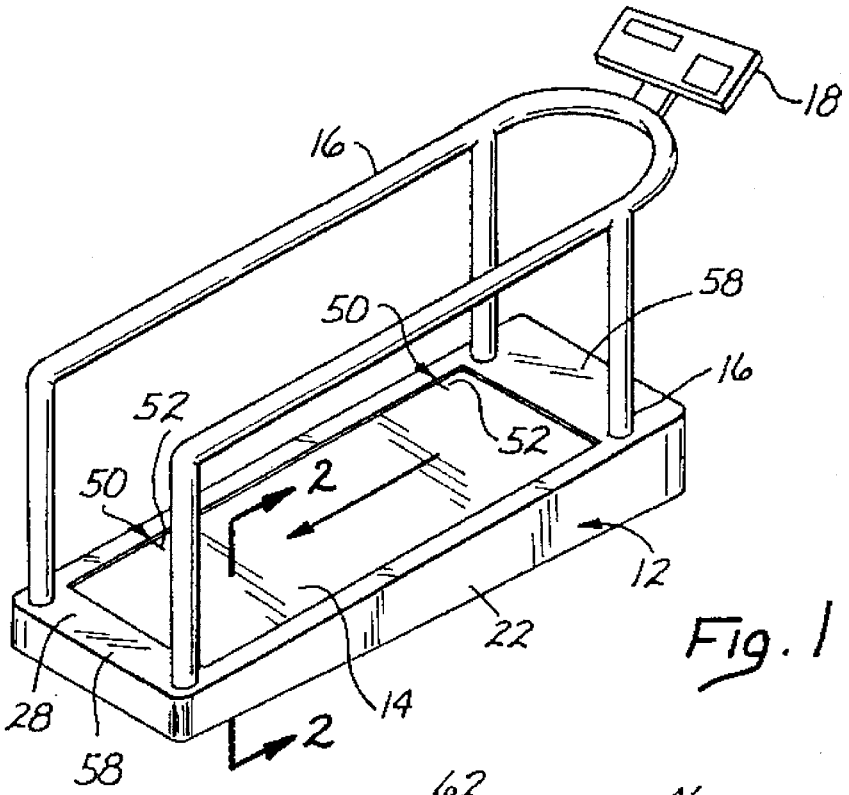
FIG. 1 is a simplified perspective view of a treadmill incorporating the invention.

Treadmill 10 shown in perspective view in FIG. 1 is comprised of a body or chassis 12 having an elongated bed along which an endless belt 14 is driven by a motor (not shown) housed within chassis 12. Chassis 12 may have one or more handrails or supports 16 provided and extending from chassis 12 to provide support or balance to the exerciser who walks or runs upon belt 14. In the preferred embodiment rail 16 completely encompasses the exerciser with a rounded safety bar so that there are not sharp extensions from the control electronics or corners that might pose a potential hazard to the user. In addition, the motor within treadmill 10 is controlled by electronics contained within a control module 18 connected to chassis 12 by a handrails 16. Many different configurations of the treadmill can be substituted consistent with these teachings and FIG. 1 is provided merely as an illustration of one context in which the invention may be used.

The longitudinal length of rotating belt 14 is sufficient to provide the normal range of walking or running stride of a human, thus is typically 20 inches wide and 54 inches long. Belt 14 is made of rubber, neoprene or other synthetic nonskid durable material, is formed in the shape of a continuous loop, and is disposed over a driving and an idler roller (not shown) at each of chassis 12. Again the control, motive, power and mechanics of treadmill 10 are only relevant by way of background to the invention, which deals with support of treadmill belt 14.

FIG. 1 show two marks 52 burned in or otherwise defined in or on belt 14 on one side of belt 14 and at a maximal or predetermined spaced distance apart at or near each end of belt 14. Also defined on chassis 12 are two markers 50 which define a predetermined distance between them. When initially installed belt 14 is stretched in treadmill 12 between its two end rollers (not shown) until belt marks 52 are aligned with chassis markers 50. At this point the amount of belt stretch and tension will be adjusted to an optimal predetermined value. For example, assume that the belt manufacturer specifies a 3% stretch as yielding the ideal tension. Assume that markers 50 are 6 feet apart. Belt 14 will be of such a length such that it will need to be stretched by 3% to make a predetermined distance between marks 52 six feet when stretched, i.e. marks 52 start at 5.83 feet apart and then are stretched to 6 feet to match markers 50. Belt 14 will now be stretched by 3%. If a belt with different characteristics is installed only the initial length or markings on belt 14 need be changed. For example, assume that belt 14 must be stretched by 5%. Belt 14 in this instance will be cut and/or marked so that the distance between marks 52 is 5.71 feet when unstretched, so that when it has been stretched so that marks 52 are separated by 6 feet to match markers 50, belt 14 will have been stretched by 5%. No special tools, measuring instruments or skills are needed to achieve the optimal stretch and tension in belt 14 using this aspect of the invention.

Because of its flexibility, treadmill belt 14 cannot be just merely tensioned and used as a moving trampoline. If it were not supported in some manner it would provide an unstable and unacceptable platform for exercise. Instead, beneath treadmill belt 14 must be provided some type of support so that the belt can support the exerciser's weight without giving way excessively under the force of the exerciser's feet.

Figure 2:
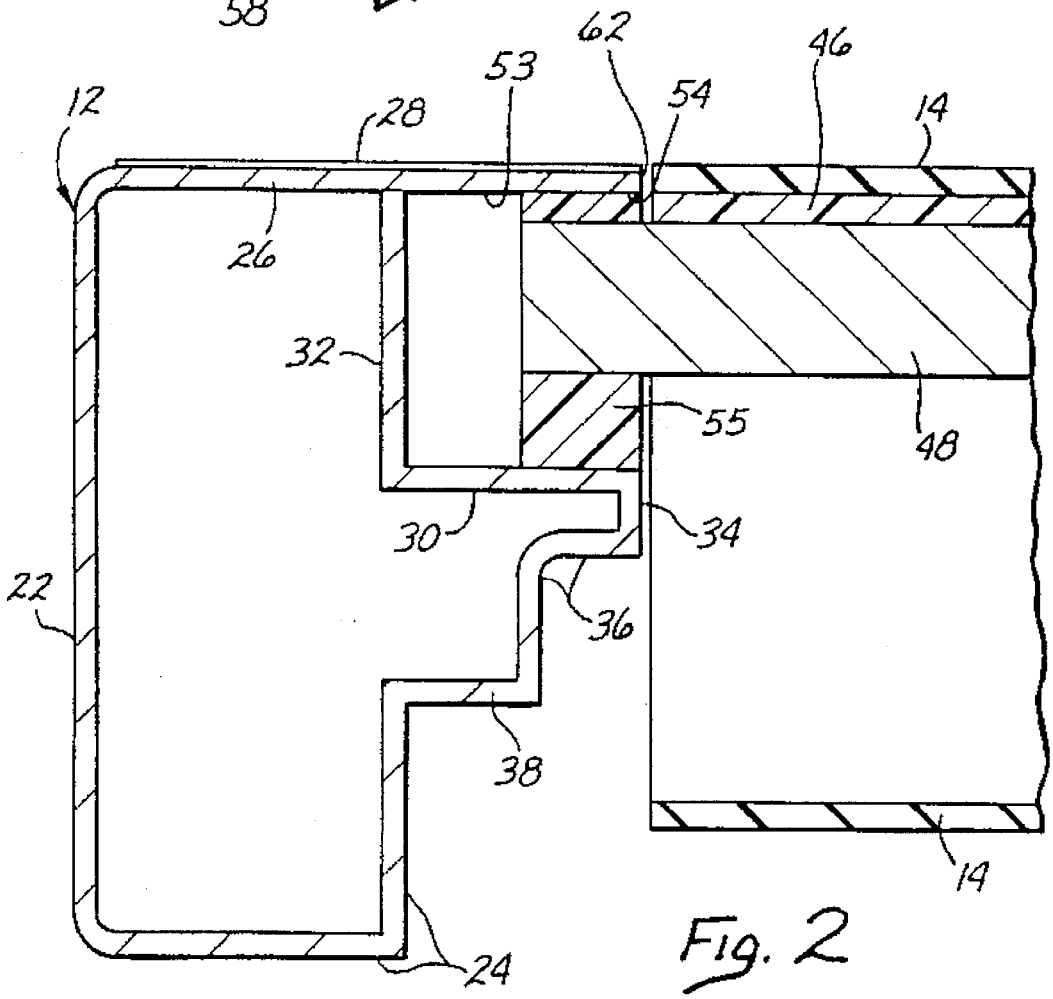
FIG. 2 is a cross section view of a portion of the treadmill chassis and belt as seen through section lines 2—2 of FIG. 1.

The improvement of the invention is better illustrated in cross sectional view in FIG. 2 wherein a side cross-sectional view of a portion of chassis 12 is shown. Chassis 12 in the illustrated embodiment is formed from extruded aluminum or bent metal or aluminum to provide a rigid vertical side wall 22, a rigid supporting foot 24 and a rigid supporting upper horizontal surface 26. Upper surface 26 is provided on its exterior side with a nonskid surface 28 which can be sprayed on, glued or adhered to upper surface 26 and which substantially covers its width. This provides a nonskid surface around the perimeter of chassis 12 so that the user can securely mount and dismount moving belt 14 at any point on the perimeter with minimal risk of slipping.

The upper portion of chassis section 12 is provided with an integrally formed supporting shelf 30. Shelf 30 is connected to upper surface 26 by means of a descending shelf wall 32. Shelf 30 continues downwardly through a short extension 34 and then is recessed outwardly by recess wall 36 to form a space for the return track of belt 14. Recess 36 is then integrally extended by outwardly extending wall 38 to join foot 24. In this manner a clearance 40 is provided beneath belt 14 when chassis 12 is positioned on the floor or a rug to avoid interference with any small objects or irregularities which may be or become positioned beneath treadmill 10.

Belt 14 rides on and is supported by an antifriction pad 46 made of wood or other material and treated to have a low friction characteristic. Any low friction surface or material now known or later devised may be used. Pad 46 is preferably softer than belt 14, or least the contacting surface of belt 14, so that pad 46 is preferentially worn or sacrificed in lieu of wearing of belt 14. Antifriction pad 46 is adhered or otherwise affixed to a structural deck 48 lying beneath pad 46 and belt 14. For example, pad 46 may be screwed down into deck 48 using recessed nylon or plastic screws to minimize wear with belt 14, but to allow easy on-site replacement of pad 46. Deck 48 is a rigid board and is typically fabricated from one inch thick wood and provides a substantially rigid structural reinforcement to pad 46 and belt 14. Deck 48 is free floating or simply lays within chassis 12 between shelf 30 and surface 53 without being fastened at any point to chassis 12. Deck 48 is retained longitudinally within at least a predetermined range of positions by means of interfering projections either extending from chassis 12 or forming part of the end structures 58 of chassis 12. For example, as diagrammatically shown in FIG. 3 deck 48 is retained in position by an angle iron flange 56 attached to shelf 30 or forming part of end structure 58 (not shown in FIG. 3). Deck 48 may also be laterally confined loosely within a predetermined range by means of a plurality of posts 64 fastened to shelf 30. Post 64 does not otherwise fasten to or secure deck 48 in any manner to chassis 12 other than to limit lateral displacement. In the preferred embodiment four such posts 64 may be provided for laterally bracketing deck 48. Since deck 48 is not fastened down, when belt 14 is removed deck 48 can be moved laterally within chassis 12 until one longitudinal edge 60 abuts surface 32 and then lifted out from the opposing side of chassis 12, since in the preferred embodiment the width of deck 48 is such that opposing longitudinal edge 60 will clear the inside edge 62 of chassis 12. Posts 64 are limited in height in order not to substantially interfere with the ease of lifting deck 48 out of chassis 12.

Figure 3:
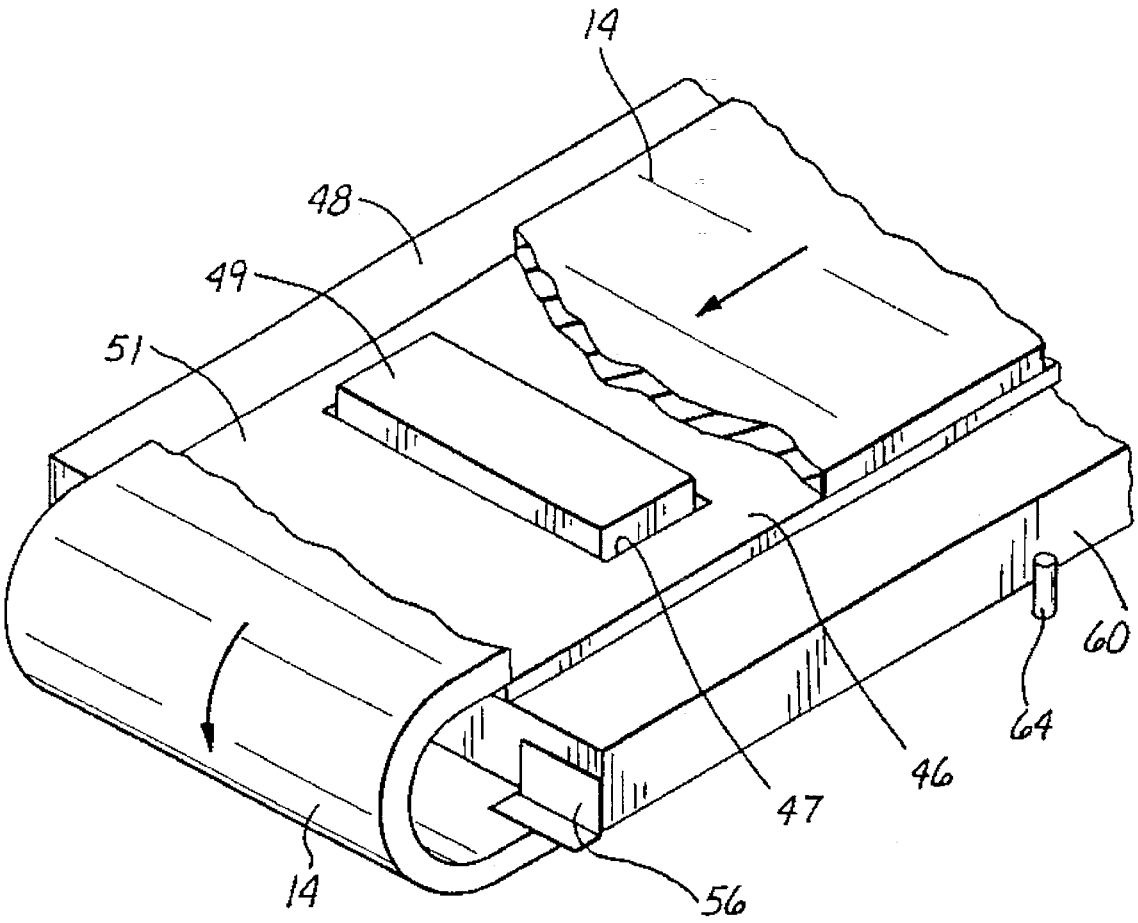
FIG. 3 is a simplified cutaway view of the endless belt and free floating deck with a lubricating block being held between the two in an aperture defined in an antifriction pad.

In another embodiment pad 46 has an aperture 47 defined therethrough or therein into which is disposed a lubricating block 49. As seen in FIG. 3 block 49 is approximately 2 by 6 by ½ inches and extends above the surface 51 of pad 46 between belt 14 and pad 46. Block 49 is supported in aperture 47 on its lower surface by deck 48. As belt 14 moves, it abrades block 49 and the solid wax or antifriction compound of which block 49 is comprised is dispensed between pad 46 and belt 14. Although only one such block 49 is depicted, a plurality of such blocks could be employed and placed across the surface of pad 46 or deck 48 to provide more even coverage or greater quantities of lubricant.

Deck 48, in turn, is peripherally supported, at least in some of the peripheral locations on shelf wall 30 and preferably along the entire longitudinal length of shelf wall 30 parallel to the edge of belt 14 by means of a thick resilient sponge 55 made of sponge rubber or other resilient material. Sponge 55 is 11/16 inch thick, and ¾ inch wide, but any dimensions may be used to provide a sufficient amount of cushioning material for deck 48. Sponge 55 is adhered to or otherwise affixed to shelf 30 and in the illustrated embodiment, deck 48 is positioned on peripheral sponge 55 and held by gravity and physical containment within the confines of chassis 12, but need not be otherwise rigidly affixed to it. In the preferred embodiment, sponge 55 is a continuous and integral strip of shock absorbing, resilient foam which extends virtually the entire longitudinal length of deck 48 and beyond to permit some longitudinal movement or adjustment of deck 48 in chassis 12.

Lower surface 53 opposing upper surface 26 is also provided with a resilient pad 54. Pad 54 is similarly adhered to or otherwise affixed to surface 53 and provides a resilient bearing surface in the case of rebound for the upper portion of belt 14 or/and towards surface 53. Pad 54, like sponge pad 55, is composed of sponge rubber or other resilient material and is approximately one inch wide and ⅛ inch thick. In the illustrated embodiment, pad 54 is slightly wider than pad 55 although the relative dimensions of each need not be related, but only of such size to serve the function called upon from each pad. Again in the preferred embodiment, sponge 55 is a continuous and integral strip of shock absorbing, resilient foam which extends virtually the entire longitudinal length of deck 48 and beyond to permit some longitudinal movement or adjustment of deck 48 in chassis 12.

Therefore, as the user walks or runs on belt 14, the impact of the foot falls are transmitted through belt 14 and antifriction pad 46 into deck 48, and absorbed by supporting peripheral pad 55. In the event that the foot falls are heavy or impulsive enough, any rebound of deck 48, pad 46 and belt 14 toward upper surface 53 is received and the impact absorbed by upper pad 54.

The result is a feeling of a firm, but cushioned supported belt 14 which provides a much more comfortable and softer walking surface than is experienced if supporting deck 48 were rigidly attached in some manner to chassis 12. Possible shock and injury from long term use or shock to the user's joints are also minimized. Because deck 48 is not fastened down on its ends or at other points, it is free to "float" within chassis 12 which also assists in its softness. For example, deck 48 tends to be more flexible at its ends as compared to similar decks, which when even elastomerically secured at their ends tend to be more flexible in the middle and stiffer at their ends.

In addition, as antifriction pad 48 preferentially wears out, being a softer material than belt 14, or otherwise loses its antifriction capabilities, it is easily and inexpensively replaced by withdrawing deck 48 from chassis 12, stripping off the worn antifriction pad 46 and attaching a new replacement pad. The cost of replacement is thus substantially decreased and the efficacy of replacement is guaranteed as compared to situations in which the entire deck 48 had to be replaced with a new polished board or had to be manually resurfaced by applying various types of polish or antifriction coatings to the top of worn deck 48. The underlying coatings of antifriction material would never be evenly worn and never provide an ideal substrate to the new coatings. The result would be that the replacement coatings do not function as well nor last as long as the virgin coating originally applied with the supporting deck. Each of these short comings of the prior art are avoided by the invention.

Many alterations and modifications may be made by those having ordinary skill in the art without departing from the spirit and scope of the invention. For example, pads 52 and 54 are described as being made of foam, but any type of shock absorbing material or means may be used, such a fibrous pads, pneumatic or hydraulic shock absorbers, or damped resilient mechanical shock absorbers.

Therefore, it must be understood that the illustrated embodiment has been set forth only for the purposes of example and that it should not be taken as limiting the invention as defined by the following claims. The following claims are, therefore, to be read to include not only the combination of elements which are literally set forth, but all equivalent elements for performing substantially the same function in substantially the same way to obtain substantially the same result. The claims are thus to be understood to include what is specifically illustrated and described above, what is conceptionally equivalent, and also what essentially incorporates the essential idea of the invention.

I claim:

1. An improvement in a treadmill exercise device having a chassis and a continuous belt supported within said chassis, said belt in turn being supported by an underlying deck, said improvement comprising;

a shock absorber disposed in said chassis beneath said deck, said shock absorber for supporting said deck and thus said belt so that impulsive foot falls on said belt are cushioned, and wherein said deck is unsecured to said chassis and free floating on said shock absorber.

2. The improvement of claim 1 further comprising an antifriction panel removably disposed on said deck between said deck and said belt.

3. An improvement in a treadmill exercise device having a chassis and a continuous belt supported within said chassis, said belt in turn being supported by an underlying deck, said improvement comprising:

a shock absorber disposed in said chassis beneath said deck, said shock absorber for supporting said deck and thus said belt so that impulsive foot falls on said belt are cushioned, and wherein said deck is unsecured to said chassis and free floating on said shock absorber; and an upper shock absorber disposed on said chassis above said belt for cushioning rebound impact of said belt and deck as a result of impulsive foot falls on said belt and deck.

4. The improvement of claim 3 wherein said upper shock absorber is comprised of resilient foam.

5. The improvement of claim 4 wherein deck has longitudinal edges and said resilient foam of said upper shock absorber is disposed on said chassis substantially along and above said longitudinal edges of said belt.

6. The improvement of claim 4 wherein said belt has peripheral edges and wherein said resilient foam of said upper shock absorber is disposed above said belt on said chassis above said peripheral edges.

7. The improvement of claim 3 further comprising an antifriction panel removably disposed on said deck between said deck and said belt.

8. An improvement in a chassis for a treadmill exercise apparatus having a continuous belt moving over a deck, said improvement comprising;

a lower shock absorber disposed within said chassis for supporting said deck, said lower shock absorber absorbing compulsive foot fall shocks transmitted to said deck by an user through said belt, and wherein said deck is freely floating on said lower shock absorber without attachment to any object, whereby said chassis provides cushioned support for said user during exercise.

9. The improvement of claim 8 wherein said chassis defines a lower belt recess, said lower belt recess for providing a protected space for return of said belt, said lower belt recess defining said protected space, said protected space being enclosed on at least three sides by said chassis and deck.

10. The improvement of claim 9 wherein said chassis is extended at its lower portion to form a foot to provide a predefined distance of protective clearance underneath said lower belt recess.

11. The improvement of claim 8 further comprising an antifriction panel disposed on said deck between said belt and deck, said antifriction panel being temporarily secured to said deck and replaceable thereon when ineffective.

12. The improvement of claim 8 wherein said lower shock absorber is composed of resilient foam, wherein said deck has longitudinal edges and said resilient foam is disposed on said chassis underneath said deck substantially along the entire length of said longitudinal edges.

13. An improvement in a chassis for a treadmill exercise apparatus having a continuous belt moving over a deck, said improvement comprising:

a lower shock absorber disposed within said chassis for supporting said deck, said lower shock absorber absorbing compulsive foot fall shocks transmitted to said deck by an user through said belt, and wherein said deck is freely floating on said lower shock absorber without attachment to any object; and an upper shock absorber disposed on said chassis between said chassis and said belt, said upper shock absorber for absorbing rebound impact of said belt and deck, whereby said chassis provides cushioned support for said user during exercise.

14. The improvement of claim 13 further comprising an antifriction panel disposed on said deck between said belt and deck, said antifriction panel being temporarily secured to said deck and replaceable thereon when ineffective.

* * * * *